US006739298B2

(12) United States Patent
Kusano et al.

(10) Patent No.: US 6,739,298 B2
(45) Date of Patent: May 25, 2004

(54) VALVE TIMING ADJUSTING APPARATUS

(75) Inventors: Shigeyuki Kusano, Kariya (JP); Masaomi Inoue, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/397,850

(22) Filed: Mar. 27, 2003

(65) Prior Publication Data

US 2003/0217716 A1 Nov. 27, 2003

(30) Foreign Application Priority Data

Mar. 27, 2002 (JP) ..... 2002-088300

(51) Int. Cl.[7] ..... F01L 1/34

(52) U.S. Cl. ..... 123/90.17; 123/90.15; 123/90.12; 464/1; 464/2; 464/160; 92/120; 92/5 L

(58) Field of Search ..... 123/90.17, 90.18, 123/90.12, 90.15, 90.31; 92/5 L, 69 R, 70, 71, 75, 120–125; 464/1, 2, 160

(56) References Cited

U.S. PATENT DOCUMENTS

| | | | | | |
|---|---|---|---|---|---|
| 6,058,897 | A | * | 5/2000 | Nakayoshi | 123/90.17 |
| 6,505,586 | B1 | * | 1/2003 | Sato et al. | 123/90.17 |
| 6,634,329 | B2 | * | 10/2003 | Kusano et al. | 123/90.17 |
| 2002/0139332 | A1 | | 10/2002 | Takenaka | 123/90.17 |

* cited by examiner

*Primary Examiner*—Thomas Denion
*Assistant Examiner*—Kyle Riddle
(74) *Attorney, Agent, or Firm*—Nixon & Vanderhye P.C.

(57) ABSTRACT

In a valve timing adjusting apparatus, rotating response speed of a vane rotor and a moving speed of a lock piston are changed according to changes of oil temperature and pressure. It sometimes happens that the lock piston passes the fitting hole before the lock piston is fitted in the fitting hole. Timing of actuating a solenoid valve is retard by a given delay time from timing of actuating a spool valve. The given delay time is decided by a map based on sensor signals representing the oil temperature and pressure input to ECU. The given delay time is shorter as the oil temperature increases and longer as the oil pressure increases.

18 Claims, 13 Drawing Sheets

VALVE TIMING ADJUSTING APPARATUS

CROSS REFERENCE TO RELATED APPLICATIONS

This application is based upon and claims the benefit of priority of Japanese Patent Application No. 2002-88300 filed on Mar. 27, 2002, the content of which is incorporated herein by reference.

BACKGROUND OF THE INVENTION

1. Field of the Invention

The present invention relates to a valve timing adjusting apparatus that adjusts valve opening and closing timing (a valve timing) of at least one of an intake valve and an exhaust valve of an internal combustion engine (engine) and a method of controlling the same.

2. Description of Related Art

There is known a valve timing adjusting apparatus in which valve timing of at least one of an intake valve and an exhaust valve is adjusted by hydraulically controlling angular phase of a driven side rotating member rotatable together with a camshaft relative to a drive side rotating member receiving drive force from a crankshaft of an engine and rotatable together with the crankshaft, that is, controlling angular phase of the camshaft relative to the crankshaft to a given value.

According to a conventional vane type valve timing adjusting apparatus, a vane as the driven side rotating member is accommodated in the drive side rotating member in such a manner that angular phase of the vane relative to the drive side rotating member is variable and defined by controlling hydraulic pressure applied to the vane. Further, according to another conventional valve timing adjusting apparatus, a drive force transmitting member disposed between the drive side rotating member and the driven side rotating member is provided with a helical spline engagement mechanism and angular phase of the driven side rotating member relative to the drive side rotating member is varied by hydraulically moving reciprocatingly the drive force transmitting member.

In the valve timing adjusting apparatus mentioned above, it is preferable for a purpose of preventing engine cranking failure when the engine is cranked that the valve timing of at least one of the intake valve and the exhaust valve is kept at a middle between the most retard timing and the most advanced timing that is the most adequate timing for securing efficient engine cranking.

For example, in the valve timing adjusting apparatus in which a piston is provided in the driven side rotating member and a fitting hole, in which the piston can be fitted, is provided in the drive side rotating member, the angular phase of the driven side rotating member relative to the drive side rotating member is locked to the middle position between the most retard angular position and the most advanced angular position by inserting the piston into the fitting hole when the engine stops. Operation of fitting the piston in the fitting hole or operation of pulling the piston out of the fitting hole is controlled by force balance between biasing force of a spring urging the piston toward the fitting hole and hydraulic pressure acting on the piston in a direction in which the piston is pulled out of the fitting hole.

Further, in a certain engine condition, for example, in a case of rapidly reducing vehicle speed during a period when the vehicle is running at high and constant speed, it is preferable for preventing abnormal engine operation that the valve timing is held within a limited range between the most retard timing and the most advanced timing by controlling the angular phase of the driven side rotating member relative to the driven side rotating member to keep within an angular range corresponding to the limited range.

For example, in the valve timing adjusting apparatus in which the drive side rotating member is provided with an arc shaped restriction hole extending in a direction in which the driven side rotating member rotates relatively to the drive side rotating member and the driven side rotating member is provided with a piston that can be inserted into the restriction hole, the angular phase of the driven side rotating member relative to the drive side rotating member is controlled within an angular range defined with opposite ends of the arc shaped restriction hole by inserting the piston into the restriction hole.

However, rotating speed of the driven side rotating member relative to the drive side rotating member, speed of inserting the piston into the fitting hole and speed of pulling the piston out of the restriction hole are variable according to changes of pressure, temperature and the like of operating oil supplied from a hydraulic pressure supply source. Accordingly, in a structure in which the angular phase of the driven side rotating member relative to the drive side rotating member is locked to the middle angular position when the piston is inserted into the fitting, hole or in a structure in which the angular phase of the driven side rotating member relative to the drive side rotating member is restricted within the angular range defined by opposite ends of the arc shaped restriction hole when the piston is inserted into the restriction hole, it sometimes happens that the piston passes the fitting or restriction hole before the piston is inserted into the hole or the piston is unlikely pulled out of the hole since the drive side rotating member excessively rotates relatively to the drive side rotating member before the piston has been pulled out of the hole.

SUMMARY OF THE INVENTION

An object of the present invention is to provide a valve timing adjusting apparatus in which a lock piston can be fitted in or pulled out of a fitting hole without fail.

Another object of the present invention is to provide a valve timing adjusting apparatus in which a restriction piston can be inserted into or pulled out of a restriction hole without fail.

A further object of the present invention is to provide a method of controlling the valve timing adjusting apparatus.

To achieve the above object, a valve timing adjusting apparatus disposed between a drive shaft of an internal combustion engine and a driven shaft causing an opening and closing operation of at least one of an intake valve and an exhaust valve and operative to change an angular phase of the driven shaft relative to the drive shaft so that opening and closing timing of the at least one of an intake valve and an exhaust valve may be varied has drive and driven side rotating members, rotation control pressure chamber, a lock piston, a fitting hole and an angular phase locking pressure chamber.

The drive side rotating member is rotated together with the drive shaft. The driven side rotating member is rotated together with the driven shaft. The rotation control pressure chamber is operative to rotate the driven side rotating member relative to the drive side rotating member so that angular phase of the driven side rotating member relative to the drive side rotating member is controlled to a target position between the most retard angle position and the most advanced angle position in response to hydraulic pressure applied thereto. The lock piston is provided in one of the driven and drive side rotating members. The fitting hole is provided in the other of the driven and drive side rotating members. The angular phase locking pressure chamber is operative to execute one of first and second operations when hydraulic pressure is applied thereto and the other of the first and second operations when application of the hydraulic pressure thereto is released. The first operation is to insert the lock piston into the fitting hole so as to lock the angular phase of the driven side rotating member relative to the drive side rotating member to a middle position between the most retard angle position and the most advanced angle position, and the second operation is to pull the lock piston out of the fitting hole so as to release lock of the angular phase of the driven side rotating member relative to the drive side rotating member at the middle position.

With the valve timing adjusting apparatus mentioned above, a supply route of the hydraulic pressure to the rotation control pressure chamber is different from that to the angular phase locking pressure chamber and, when at least one of the first and second operations is executed, start timing of rotation of the driven side rotating member relative to the drive side rotating member so as to change the angular phase of the driven side rotating member relative to the drive side rotating member to the target position is retard by a given delay time from start timing of execution of the at least one of the first and second operations.

It is preferable that the lock piston is provided at an axial end thereof with a tapered portion whose diameter is smaller toward the round hole, the fitting hole is provided at an opening end thereof with a chamfering portion whose diameter is larger toward the piston, and, when the first operation is executed, the given delay time by which the start timing of rotation of the driven side rotating member relative to the drive side rotating member is retard from the start timing of execution of the first operation is larger than time required for the tapered portion to pass the chamfering portion after the first operation starts.

When the intake or exhaust valve is driven, the driven shaft receives fluctuating torque acting in retard or advanced angle direction. Since average of the fluctuating torque acts in a retard angle direction, the driven side rotating member receives the fluctuating torque which causes the angular phase of the driven side rotating member relative to the drive side rotating member to change in retard angle direction.

Accordingly, it is preferable that, after the second operation starts, the hydraulic pressure is applied to the rotation control pressure chamber in such a manner that the angular phase of the driven side rotating member relative to the drive side rotating member is kept at the middle position between the most retard angle position and the most advanced angle position or temporarily moved to a position slightly shifted from the middle position toward the advanced angle position before the given delay time lapses. Since the fluctuating torque acting on the driven side rotating member in retard angle direction is reduced, the lock piston can be pulled out of the fitting hole with less frictional resistance.

A rotation speed of the driven side rotating member relative to the drive side rotating member and a moving speed of the lock piston are variable according to change of pressure of the operation oil. Further, the rotation speed of the driven side rotating member relative to the drive side rotating member and the moving speed of the lock piston are also variable according to change of viscosity of the operation oil that is changed by temperature of the operation oil.

Accordingly, it is preferable that the given delay time by which the start timing of rotation of the driven side rotating member relative to the drive side rotating member is retard from the start timing of execution of the at least one of the first and second operations is determined by sensor signals representing pressure and temperature of fluid applied to at least one of the rotation control pressure chamber and the angular phase locking pressure chamber.

Preferably, the valve timing adjusting apparatus further has a restriction piston, a restriction hole and an angular phase restriction pressure chamber. The restriction piston is provided in one of the driven and drive side rotating members. The restriction hole is formed in shape of an arc extending within a given angular range and provided in the other of the driven and drive side rotating members. The angular phase restriction pressure chamber is operative to execute one of third and fourth operations when hydraulic pressure is applied thereto and the other of the third and fourth operations when application of the hydraulic pressure thereto is released. The third operation is to insert the restriction piston into the restriction hole so as to restrict rotation of the driven side rotating member relative to the drive side rotating member within the given angular range and the fourth operation is to pull the restriction piston out of the restriction hole so as to release restriction of rotation of the driven side rotating member relative to the drive side rotating member within the given angular range. With the construction mentioned above, a supply route of the hydraulic pressure to the angular phase restriction pressure chamber is same as that to the angular phase locking pressure chamber, an end of the given angular range is at a position corresponding to the middle position between the most retard angle position and the most advanced angle position and the other end of the given angular range is at a position away from the middle position toward the most advanced angle position and, when the third operation is executed together with the first operation, the restriction piston abuts on the end of the given angular range within the restriction hole.

As an alternative, a valve timing adjusting apparatus disposed between a drive shaft of an internal combustion engine and a driven shaft causing an opening and closing operation of at least one of an intake valve and an exhaust valve and operative to change an angular phase of the driven shaft relative to the drive shaft so that opening and closing timing of the at least one of an intake valve and an exhaust valve may be varied has drive and driven side rotating members, rotation control pressure chamber, a restriction piston, a restriction hole and an angular phase restriction pressure chamber.

The drive side rotating member is rotated together with the drive shaft. The driven side rotating member is rotated together with the driven shaft. The rotation control pressure chamber is operative to rotate the driven side rotating member relative to the drive side rotating member so that angular phase of the driven side rotating member relative to the drive side rotating member is controlled to a target position between the most retard angle position and the most advanced angle position in response to hydraulic pressure applied thereto. The restriction piston is provided in one of the driven and drive side rotating members. The restriction hole is provided in the other of the driven and drive side rotating members. The angular phase restriction pressure chamber is operative to execute one of first and second operations when hydraulic pressure is applied thereto and the other of the first and second operations when application of the hydraulic pressure thereto is released. The first operation is to insert the restriction piston into the restriction hole so as to restrict rotation of the driven side rotating member relative to the drive side rotating member within the given angular range and the fourth operation being to pull the restriction piston out of the restriction hole so as to release restriction of rotation of the driven side rotating member relative to the drive side rotating member within the given angular range.

With the valve timing adjusting apparatus mentioned above, a supply route of the hydraulic pressure to the rotation control pressure chamber is different from that to the angular phase restriction pressure chamber and, when at least one of the first and second operations is executed, start timing of rotation of the driven side rotating member relative to the drive side rotating member so as to change the angular phase of the driven side rotating member relative to the drive side rotating member to the target position is retard by a given delay time from start timing of execution of the at least one of the first and second operations.

When the first operation is executed, the hydraulic pressure is applied to the rotation control pressure chamber in such a manner that, if the restriction piston is outside the given angular range of the restriction hole, the angular phase of the driven side rotating member relative to the drive side rotating member is temporarily moved to a position slightly inside the given angular range of the restriction hole before the given delay time lapses, whereby, when the driven side rotating member is rotated relatively to the drive side rotating member after the given delay time lapses, the target position of the angular phase of the driven side rotating member relative to the drive side rotating member is restricted within the given angular range since the restriction piston abuts on the retard angle side end or the advanced angle side end.

Further, it is preferable that, after the second operation starts, the hydraulic pressure is applied to the rotation control pressure chamber in such a manner that, before the given delay time lapses, the angular phase of the driven side rotating member relative to the drive side rotating member is temporarily moved to a position slightly away inward from the retard angle side end or the advanced angle side end of the restriction hole on which the restriction piston abuts so as to pull smoothly the restriction piston out of the restriction hole.

Preferably, the given delay time by which the start timing of rotation of the driven side rotating member relative to the drive side rotating member is retard from the start timing of execution of the at least one of the first and second operations is determined by sensor signals representing pressure and temperature of fluid applied to at least one of the rotation control pressure chamber and the angular phase restriction pressure chamber.

The valve timing adjusting apparatus further has a lock piston, a fitting hole and an angular phase locking pressure chamber. The lock piston is provided in one of the driven and drive side rotating members. The fitting hole is provided in the other of the driven and drive side rotating members. The angular phase locking pressure chamber is operative to execute one of third and fourth operations when hydraulic pressure is applied thereto and the other of the third and fourth operations when application of the hydraulic pressure thereto is released. The third operation is to insert the lock piston into the fitting hole so as to lock the angular phase of the driven side rotating member relative to the drive side rotating member to a given position within the given angular range of the restriction hole and the second operation is to pull the lock piston out of the fitting hole so as to release lock of the angular phase of the driven side rotating member relative to the drive side rotating member at the given position.

With the construction mentioned above, a supply route of the hydraulic pressure to the angular phase locking pressure chamber is same as that to the rotation control pressure chamber.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Embodiments of the present invention are described with reference to figures.

(First Embodiment)

Figure 1:
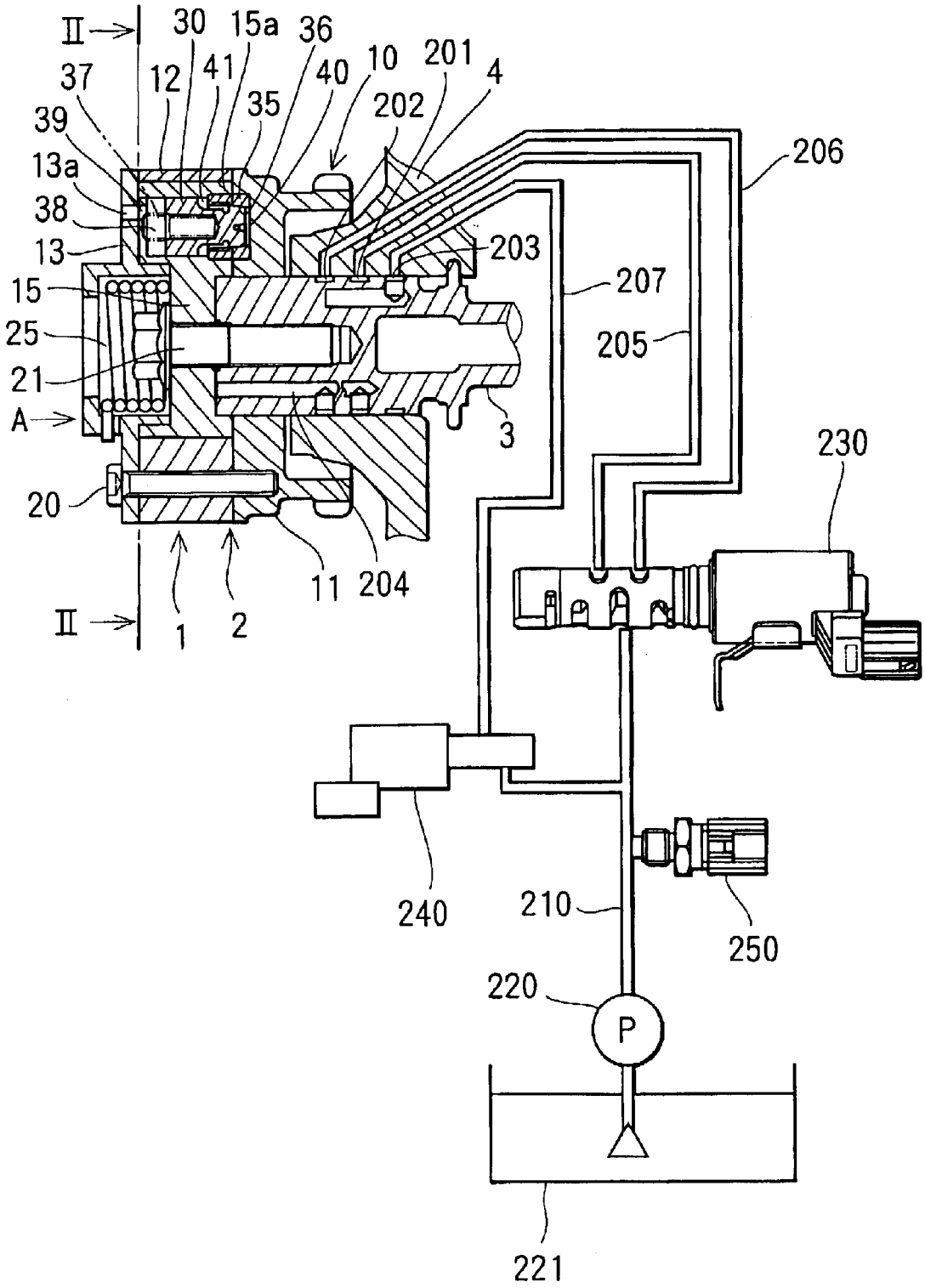
FIG. 1 is a cross sectional view of a valve timing adjusting apparatus according to a first embodiment of the present invention.
Figure 2:
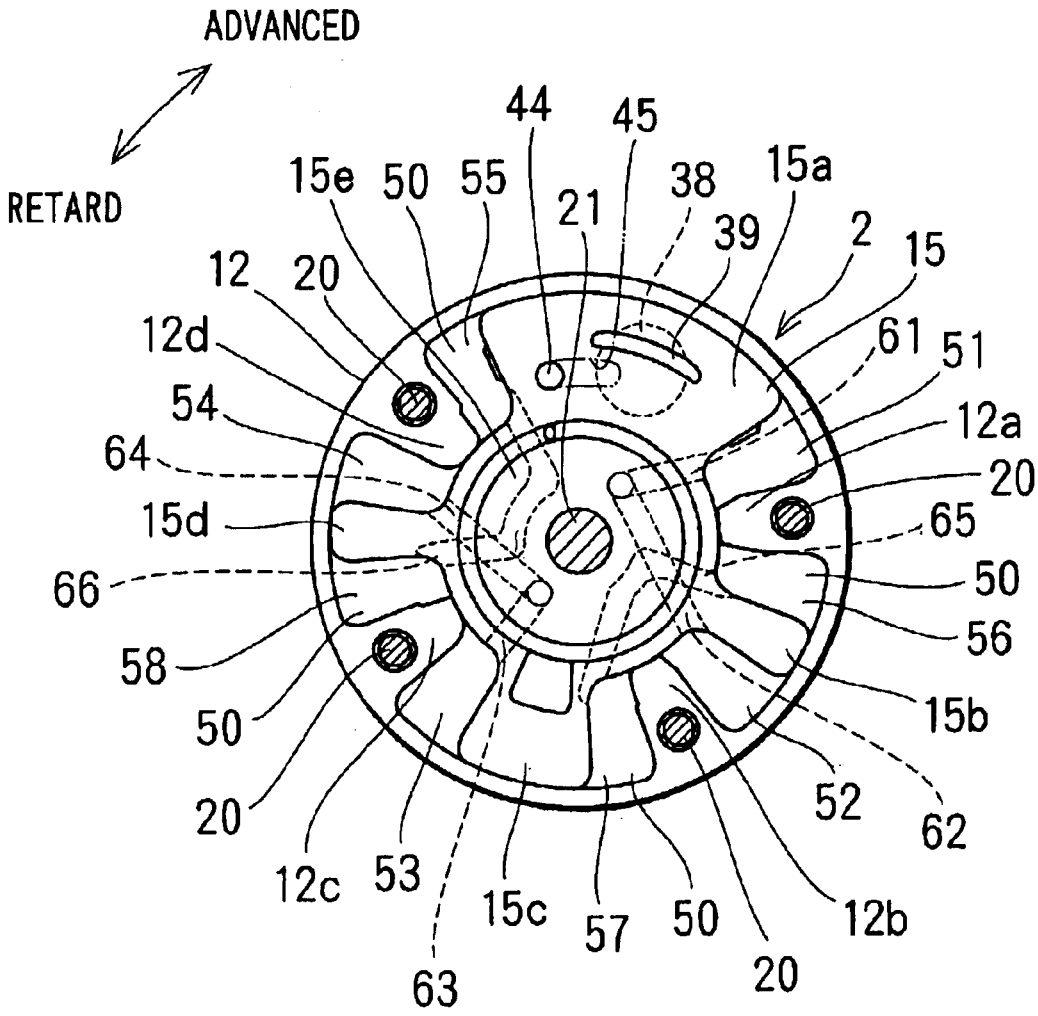
FIG. 2 is a cross sectional view taken along a line II—II in FIG. 1.

As shown in FIGS. 1 and 2, a valve timing adjusting apparatus 1 is a hydraulic control device for adjusting a valve timing of an intake valve. The valve timing adjusting apparatus 1 is composed of a main body 2, a camshaft 3, a bearing 4 for the camshaft 3, a spool valve 230 as a first electrically controlled valve and a solenoid valve 240 as a second electrically controlled valve.

As shown in FIG. 1, drive force of a crankshaft (not shown) constituting a drive shaft is transmitted through the main body 2 to the camshaft 3 constituting a driven shaft. A cam formed in the camshaft 3 drives the intake valve. The main body 2 has a housing 10, vane rotor 15, a lock piston 30 and a restriction piston 44 (refer to FIG. 4). The housing 10 is a drive side rotating member and has a timing gear 11 constituting a side wall, a circumferential wall 12 and a front plate 13 constituting the other side wall. The timing gear 11 and the front plate 13 are in contact with opposite axial ends of the circumferential wall 12, respectively. The timing gear 11, the circumferential wall 12 and the front plate 13 are concentrically fixed to one another by bolts. The timing gear 11 is connected via gears (no shown) to the crankshaft for receiving drive force therefrom and rotating together with the crankshaft.

The camshaft 3 is held by the bearing 4. The drive force of the crankshaft is transmitted via the housing 10 and the vane rotor 15 to the camshaft 3 for an opening and closing operation of the intake valve (not shown). The camshaft 3 is rotatable with the timing gear 11 with a given angular phase difference therebetween. The housing 10 and the camshaft 3 rotate clockwise when viewed in a direction of an arrow A in FIG. 1. This clockwise direction is advanced angle direction.

As shown in FIG. 2, the circumferential wall 12 is provided at an inner circumference thereof with four shoes 12*a*, 12*b*, 12*c* and 12*d*, that is, partitions formed in trapezoidal shape, arranged circumferentially at generally regular intervals. Each of inner circumferential surfaces of the shoes 12*a*, 12*b*, 12*c* and 12*d* is formed in arc cross sectional shape. Four fan shaped accommodation chambers 50 are formed in circumferential spaces between adjacent two of the shoes 12*a*, 12*b*, 12*c* and 12*d*. Vanes 15*a*, 15*b*, 15*c* and 15*d* are accommodated in the accommodation chambers 50, respectively, and movable circumferentially within a given angular range.

The vane rotor 15 has a boss 15*e* and the vanes 15*a*, 15*b*, 15*c* and 15*d* that are arranged around the boss 15*e* circumferentially at generally regular intervals. The vanes 15*a*, 15*b*, 15*c* and 15*d* are rotatably accommodated in the accommodation chambers 50. Each of the accommodation chambers 50 is partitioned by each of the vanes into two rooms. One is a retard angle hydraulic chamber and the other one is an advanced angle hydraulic chamber. Arrows in FIG. 2 represent retard and advanced angle directions when the vane rotor 15 rotates relatively to the housing 10. The vane rotor 15 representing the driven side rotating member is in contact with an axial end of the camshaft 3 and fixed to the camshaft 3 by a bolt 21.

A spring 25 is inserted between the front plate 13 and the vane rotor 15. An end of the spring 25 is retained by the front plate 13 and the other end thereof is retained by the vane rotor 15. The spring 25 urges the vane rotor 15 in the advanced angle direction relative to the front plate 13.

The vane rotor 15 is rotatable relatively to the housing 10. Inner surfaces of the housing 10 at opposite axial ends, that is, inner walls of the timing gear 11 and the front plate 13, are in slidable contact with outer surfaces of the vane rotor 15 at the opposite axial ends, respectively. Inner circumference of the circumferential wall 12 is in slidable contact with an outer circumference of the vane rotor 15.

Figure 3:
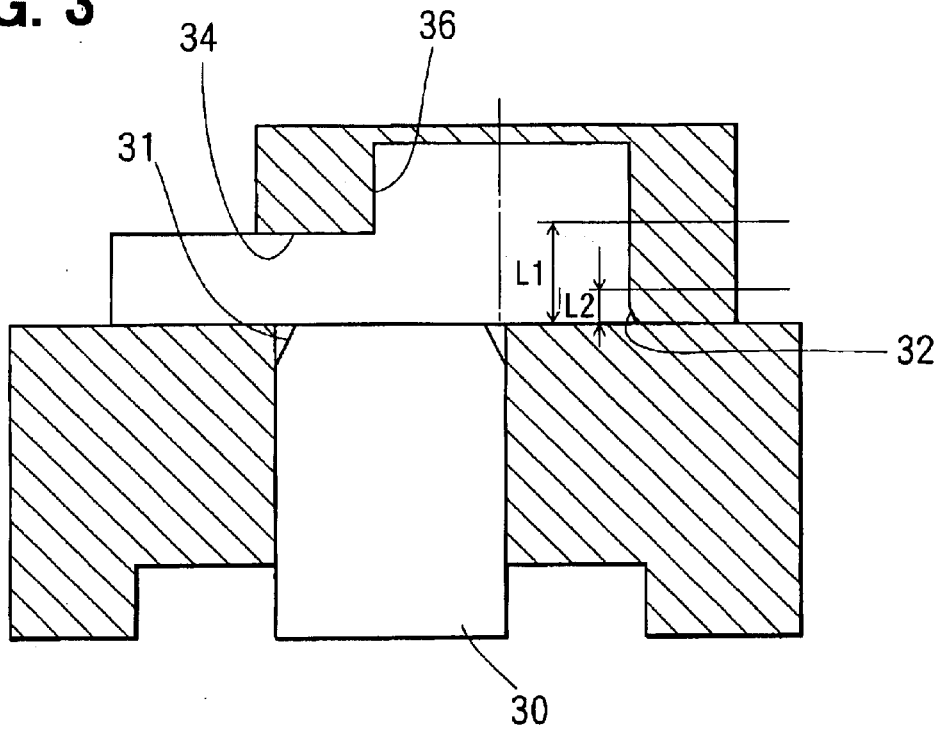
FIG. 3 is schematic cross sectional views of a lock piston and a fitting hole according to the first embodiment.

As shown in FIG. 1, the lock piston 30 constituting a cylindrical locking member is accommodated to move axially and reciprocatingly in an accommodation hole 38 formed in the vane 15*a*. The timing gear 11 is provided with an arc shaped elongated hole 34 (refer to FIGS. 3 and 4) whose depth is deeper at an advanced angle end. A fitting ring 35 is press fitted to the elongated hole 34 at the advanced angle end and constitutes a fitting hole 36. The lock piston 30 can be inserted into and fitted in the fitting hole 36. The lock piston 30 is provided at an axial end thereof with a tapered portion 31 whose diameter is smaller toward the fitting hole 36. The fitting hole 36 is provided at an opening end thereof with a chamfering portion 32 whose diameter is larger toward the lock piston 30 so that the lock piston 30 is smoothly inserted into the fitting hole 36. When the lock piston 30 enters toward the fitting hole 36 by more than length L1 from an entrance of the fitting hole, as shown in FIG. 3, the lock piston 30 is fitted in the fitting hole 36. When the lock piston 30 enters toward the fitting hole 36 or the elongated hole 34 by more than length L2 corresponding to a longer one of axial length of the tapered portion 31 and axial length of the chamfering portion 36, as shown in FIG. 3, the lock piston 30 does not pass the fitting hole 36 or the elongated hole 34. A spring 37 as biasing means for the locking member urges the lock piston 30 toward the fitting hole 36.

Pressure of operation oil applied to piston chambers 40 and 41, both of which are operative as lock releasing chambers, urges the lock piston 30 to be pulled out of the fitting hole 36. The lock piston 30, the fitting hole 36, the spring 37 and the piston chambers 40 and 41 constitute angular phase locking means. The piston chambers 40 and 41 communicate with a piston oil passage 203 for releasing hydraulic pressure. The lock piston 30 can be inserted into the fitting hole 36 when an angular phase of the vane rotor 15 relative to the housing 10 is at a middle position between the most retard angle position and the most advanced angle position and, in a state that the lock piston 30 is fitted in the fitting hole 36, rotation of the vane rotor 15 relative to the housing 10 is locked. The middle position at which the lock piston 30 is fitted in the fitting hole 36 is set to a valve timing of the intake valve suitable for engine cranking.

When the vane rotor 15 rotates relatively to the housing 10 toward the retard or advanced angle position beyond the middle position, the lock piston 30 can not be fitted in the fitting hole 36 since the piston 30 is not angularly aligned with the fitting hole 36.

A communication passage 13*a* formed in the front plate 13 shown in FIG. 1 communicates via an arc shaped communication hole 39 formed in the vane 15*a* with an accommodation hole 38 formed on an opposite side of the fitting hole 36 with respect to the lock piston 30. The lock piston 30 can move reciprocatingly without receiving any resistance from the operation oil since the communication passage 13*a* is opened to atmosphere.

Figure 4:
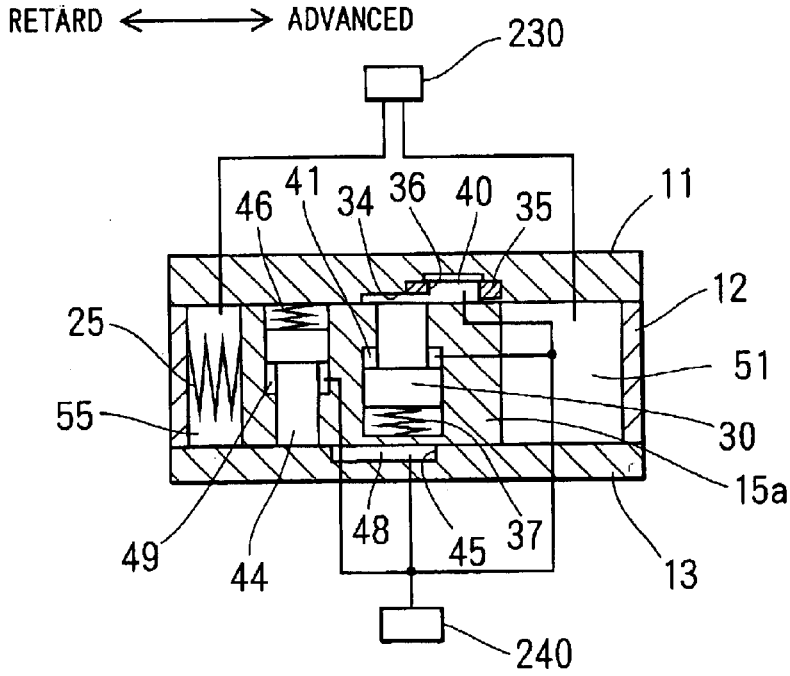
FIG. 4 is a schematic view showing oil passages according to the first embodiment.

As shown in FIG. 4, a restriction piston 44 is accommodated in the vane 15*a* so as to move reciprocatingly in an axial direction of the vane 15*a*. An arc shaped restriction hole 45 is formed to extend within a given angular range in the front plate 13. The restriction piston 44 can be inserted into the restriction hole 45. A spring 46 as restriction biasing means urges the piston 44 toward the restriction hole 45.

Pressure of operation oil applied to piston chambers 48 and 49, both of which are operative as restriction releasing chambers, urges the restriction piston 44 to be pulled out of the restriction hole 45. The restriction piston 44, the restriction hole 45, the spring 46 and the piston chambers 48 and 49 constitute angular phase restriction means. The piston chambers 48 and 49 communicate with the piston oil passage 203 similarly to the piston chambers 40 and 41. The operation oil is supplied to the piston chambers 40, 41, 48 and 49 commonly from the same hydraulic pressure source via the same supply route so that moving start timings of the lock and restriction pistons 30 and 44 are generally same. A retard angle side end of the restriction hole 45 corresponds to the middle position where the lock piston 30 is fitted in the fitting hole 36. Accordingly, the restriction piston 44 abuts on the retard angle side end of the restriction hole 45 in a state that the lock piston 30 is fitted in the fitting hole 36.

As shown in FIG. 2, retard angle hydraulic pressure chambers 51, 52, 53 and 54 are formed between the shoe 12*a* and vane 15*a*, between the shoe 12*b* and the vane 15*b*, between the shoe 12*c* and the vane 15*c* and between the shoe 12*d* and the vane 15*d*, respectively. Advanced angle hydraulic chambers 55, 56, 57 and 58 are formed between the shoe 12*d* and vane 15*a*, between the shoe 12*a* and the vane 15*b*, between the shoe 12*b* and the vane 15*c* and between the shoe 12*c* and the vane 15*d*, respectively.

As shown in FIG. 1, the camshaft 3 is provided on an outer circumferential wall thereof that slides on an inner circumferential wall of the bearing 4 with an advance angle oil passage 202, a retard angle oil passage 201 and the piston oil passage 203 which are formed in a ring shape and spaced in an axial direction thereof. The retard angle oil passage 201 and the advanced angle oil passage 202 are connected to the spool valve 230 to be driven electro-magnetically via oil passages 205 and 206, respectively. The piston oil passage 203 is connected to the solenoid valve 240 via an oil passage 207. A hydraulic pressure supply route through which the operation oil is supplied to the retard angle oil passage 201 and the advanced angle oil passage 202 is different from hydraulic pressure supply route through which the operation oil is supplied to the piston oil passage 203. In the former route, the operation oil is hydraulically controlled by the spool valve 230 to be driven electro-magnetically and, in the latter route, the operation oil is hydraulically controlled by the solenoid valve 240.

An oil supply passage 210 is connected to an oil pump 220. The oil pump 220 is a mechanical pump rotatable with the engine. The oil pump 220 can supply the operation oil drawn up from a drain 221 to the retard angle oil passage 201 and the advanced angle oil passage 202 via the spool valve 230 and to the piston oil passage 203 via the solenoid valve 240. An oil temperature sensor 250 detects temperature of the operation oil of the oil supply passage 210.

The spool valve 230 is duty ratio controlled by an electrically control unit (ECU) for the engine (not shown). The spool valve 230 controls hydraulic pressure of the respective retard and advanced angle hydraulic chambers 51 to 54 and 55 to 58 in such a manner that reciprocating movement of a spool (not shown) allows or prohibits the oil passage 205 or the oil passage 206 to communicate with the oil supply passage 210 or the drain 221.

The solenoid valve is also controlled by ECU. The oil passage 207 communicates with the oil supply passage 210 upon energizing the solenoid valve 240 and is opened to the drain 221 upon de-energizing the solenoid valve 240.

As shown in FIG. 2, oil passages 61, 62, 63 and 64 that are formed in the vane rotor 15 communicate with the retard angle oil passage 201 via oil passages formed in the vane rotor 15 and the camshaft 3. The oil passages 61, 62, 63 and 64 communicate with the retard angle hydraulic chambers 51, 52, 53 and 54, respectively.

Oil passages 65 and 66 are formed in an end surface of the vane rotor 15 in contact with an axial end of the camshaft 3 and communicates with the advanced angle oil passage 202 via an oil passage 204 formed in the camshaft 3. The oil passage 65 communicates with the advanced angle hydraulic chambers 56 and 57 and the oil passage 66 communicates with the advanced angle hydraulic chambers 55 and 58.

With the construction mentioned above, the operation oil from the oil pump 22 can be supplied to the retard angle hydraulic chambers 51, 52, 53 and 54, the advanced angle hydraulic chambers 55, 56, 57 and 58 and the piston chambers 40, 41, 48 and 49 and the operation oil can be ejected from the respective hydraulic chambers to the drain 221.

An operation of the valve timing adjusting apparatus 1 is described.

When the solenoid valve 240 is energized at a normal engine operation, the operation oil is supplied to the piston chambers 40, 41, 48 and 49 from the piston oil passage 203. As shown in FIG. 4, hydraulic pressures of the piston chambers 40 and 41 cause the lock piston 30 to pull out of the fitting hole 36 against biasing force of the spring 37. Hydraulic pressures of the piston chambers 48 and 49 cause the restriction piston 44 to pull out of the restriction hole 45 against biasing force of the spring 46. At this time, the vane rotor 15 is rotatable relatively to the housing 10. Pressures applied to the respective retard and advanced angle hydraulic chambers are adjusted by a duty ratio control of the spool valve 230 so that angular phase of the camshaft 3 relative to the crankshaft is defined.

When an ignition key is turned on to stop the engine, the engine is generally in an idling operation state. In the idling operation state, the valve timing of the intake valve is set generally to an intermediate position between a middle position and the most retard angle position. Current for driving the spool valve 230 is controlled for a certain period just before the engine stops so as to cause the advanced angle oil passage 202 to communicate with the oil supply passage 210 so that the operation oil is supplied to the respective advanced angle hydraulic chambers. Since the retard angle oil passage 201 is opened to the drain 221, the operation oil of the respective retard angle hydraulic chambers is ejected via the retard angle oil passage 201. Accordingly, the vane rotor 15 rotates relatively to the housing 10 toward the middle position from the intermediate position between the middle position and the most retard angle position. Further, when the engine stops, the solenoid valve 240 is de-energized so that the piston oil passage 203 is opened to the drain 221. Accordingly, the operation oil of the piston chambers 40, 41, 48 and 49 is ejected via the piston oil passage 203. The lock piston 30 is moved toward the fitting hole 36 by the biasing force of the spring 37 and the restriction piston 44 is moved toward the restriction hole 45 by the biasing force of the spring 46.

When the vane rotor 15 rotates relatively to the housing 10 to the middle position, the lock piston 30 is fitted in the fitting hole 36 so that the angular phase of the vane rotor 15 relative to the housing 10 is locked.

Figure 5:
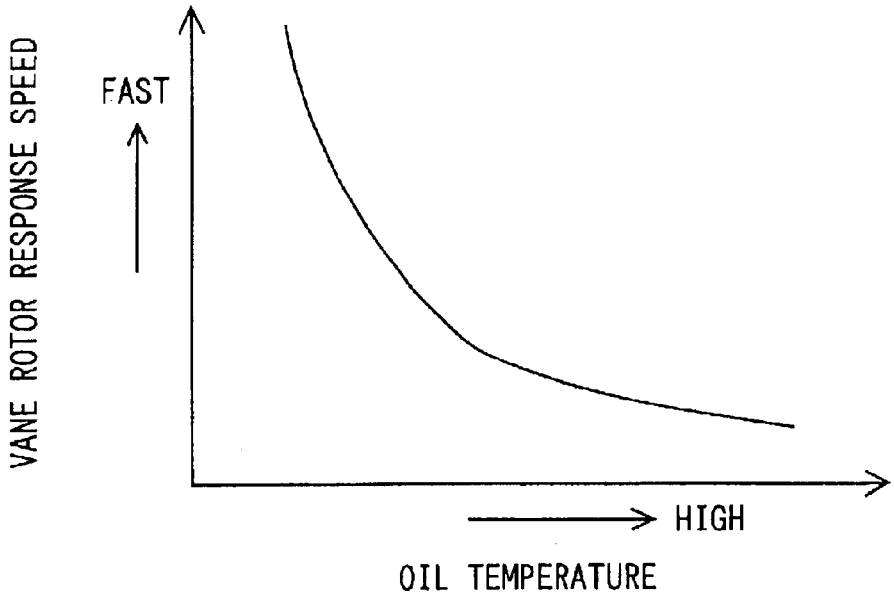
FIG. 5 is a characteristic graph showing relationship between oil temperature and a response speed.
Figure 6:
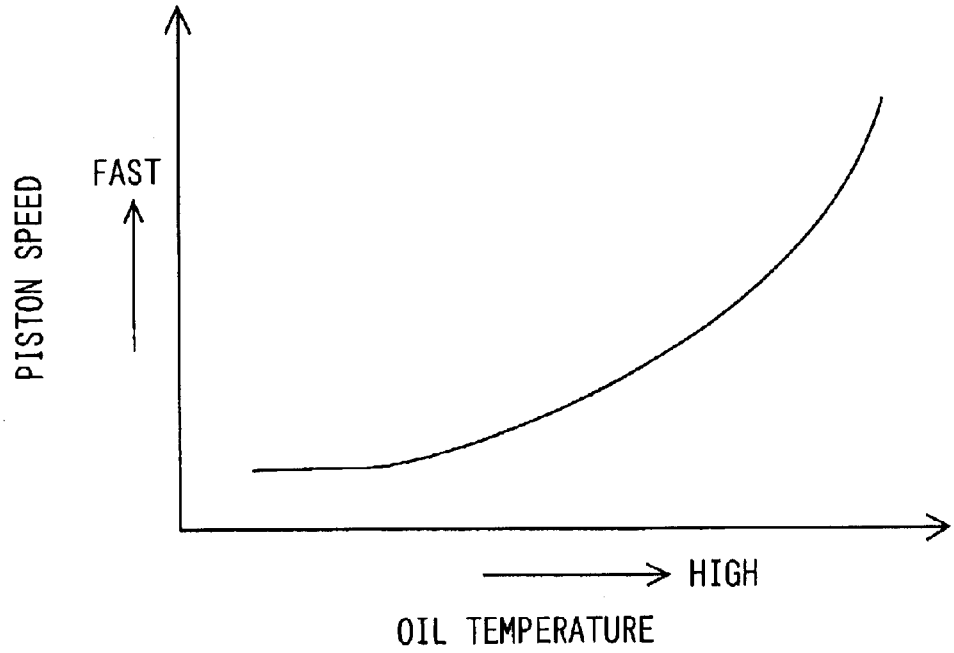
FIG. 6 is a characteristic graph showing relationship between oil temperature and a moving speed of the lock piston.

Retard and advanced angle responsive speed of rotating the vane rotor 15 relatively to the housing 10, speed of inserting the lock piston 30 into the fitting hole 36 and speed of inserting the restriction piston 44 into the restriction hole 45 are variable according to changes of viscosity of the operation oil, that is, temperature and pressure of the operation oil. For example, as shown in FIG. 5, as the viscosity of the operation oil decreases with increase of temperature of the operation oil, the pressure of the operation oil decreases so that the retard and advanced angle responsive speed of rotating the vane rotor 15 relatively to the housing 10 becomes slower. Further, as the viscosity of the operation oil decreases with increase of temperature of the operation oil, the operation oil is more easily ejected from the piston chambers 40, 41, 48 and 49 so that moving speed of the lock piston 30 and moving speed of the restriction piston 44 become faster. On the other hand, as the pressure of the operation oil increases, the retard and advanced angle responsive speed becomes faster and the moving speed of the lock piston 30 and the moving speed of the restriction piston 44 become slower. Furthermore, speed of pulling the lock piston 30 out of the fitting hole 36 and speed of pulling the restriction piston 44 out of the restriction hole 45 are also changed according to changes of the temperature and pressure of the operation oil. In any way, the retard and advanced angle responsive speed of rotating the vane rotor relatively to the housing 10 varies inversely with the moving speeds of the lock and restriction pistons 30 and 44 when the temperature and pressure of the operation oil are changed. The moving speeds of the lock and restriction pistons 30 and 44 are substantially same. Further, since the operation oil is supplied to the piston chambers 40, 41, 48 and 49 via the same supply route from the same hydraulic pressure source, start timing of moving the lock piston 30 to be inserted into the fitting hole 36 is substantially same as start timing of moving the restriction piston 44 to be inserted into the restriction hole 45.

If the spool valve 230 and the solenoid valve 240 are actuated substantially at the same time so that the start timing of moving the lock piston 30 to be inserted into the fitting hole 36 (lock start timing) or the start timing of moving the rock piston 30 to be pulled out of the fitting hole 36 (lock release start timing) is substantially same as the start timing of rotating the vane rotor 15 relatively to the housing 10 to a target position (rotation start timing), it sometimes happens that the lock piston 30 passes the fitting hole 36 before the lock piston 30 is fitted in the fitting hole 36 or the lock piston 30 can not be pulled out of the fitting hole 36 because the lock piston 30 is pressed against an inner wall of the fitting hole 36.

Figure 7:
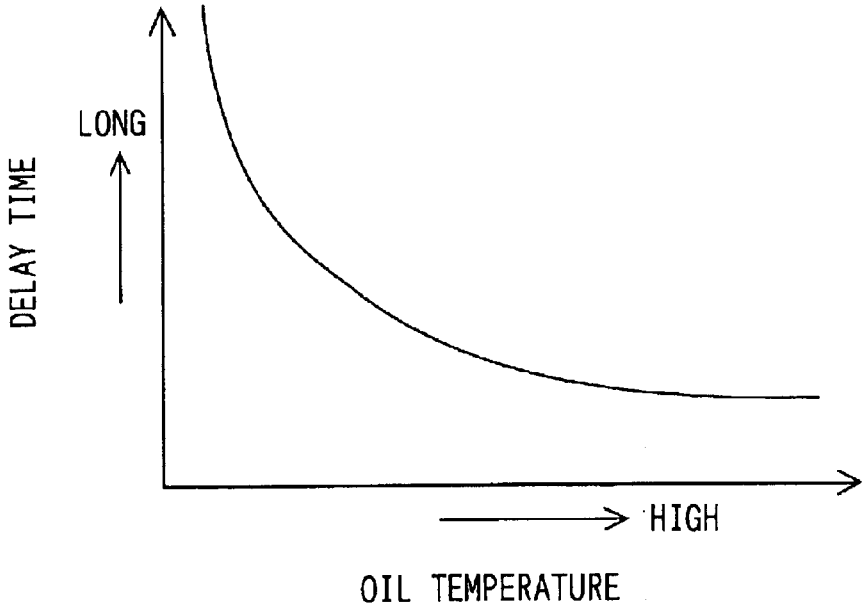
FIG. 7 is a characteristic graph showing a relationship between oil temperature and delay time.
Figure 8:
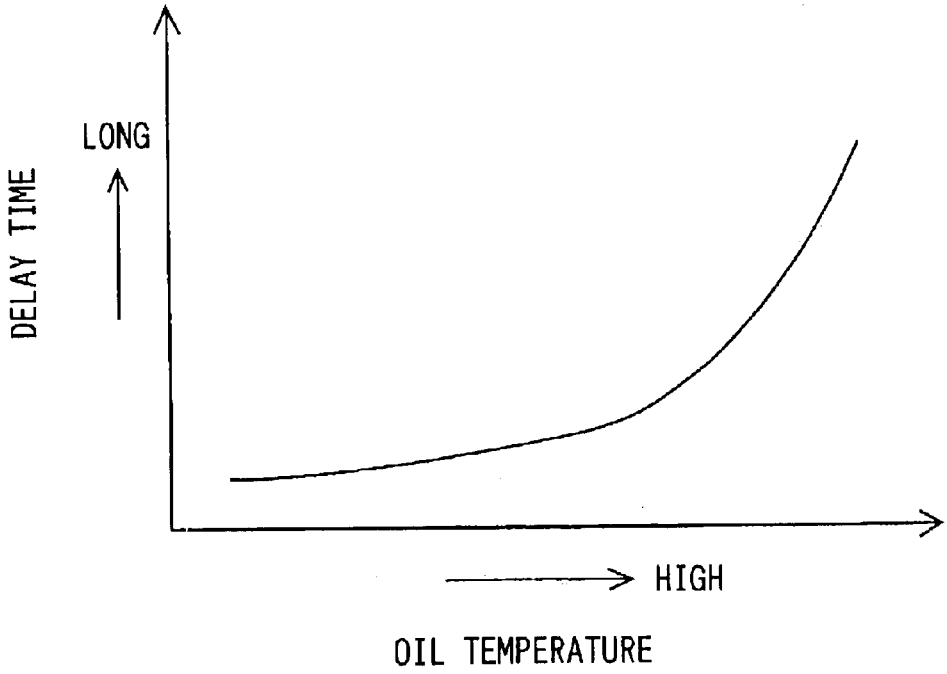
FIG. 8 is a characteristic graph showing a relationship between oil pressure and delay time.

According to the first embodiment, the lock start timing or the lock release start timing, which is controlled by the solenoid valve 240, is retard by a given delay time from the rotation start timing, which is controlled by the spool valve 230. The given delay time is decided with reference to a delay time map by sensor signals representing the temperature and pressure of the operation oil that are input to ECU. As shown in FIGS. 7 and 8, the given delay time is shorter with increase of the temperature of the operation oil and longer with increase of the pressure of the operation oil. Instead of the sensor signal from the oil temperature sensor 250, a sensor signal from a water temperature sensor may be used. Further, instead of the sensor signal from a oil pressure sensor, a sensor signal from an engine revolution sensor may be used. The pressure of the operation oil increases with increase of the engine revolution and decreases with decrease of the engine revolution.

Figure 9A:
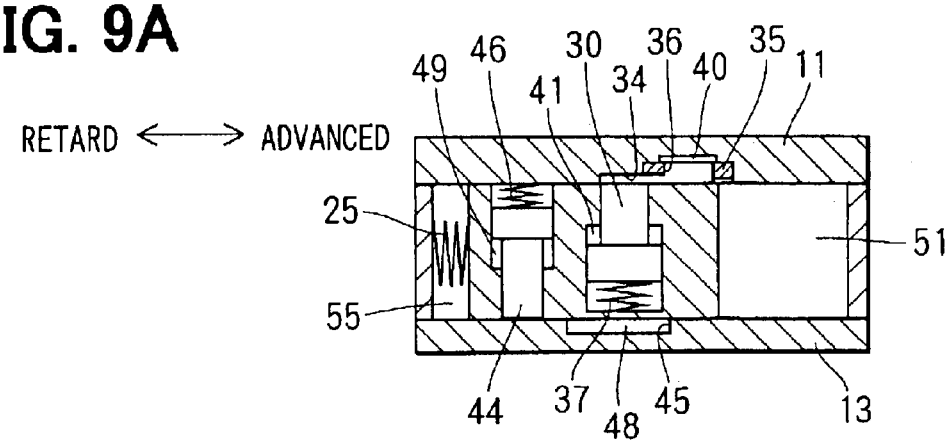
FIGS. 9A, 9B and 9C are schematic views showing an operation of the lock piston to be inserted into the fitting hole according to the first embodiment.
Figure 9B:
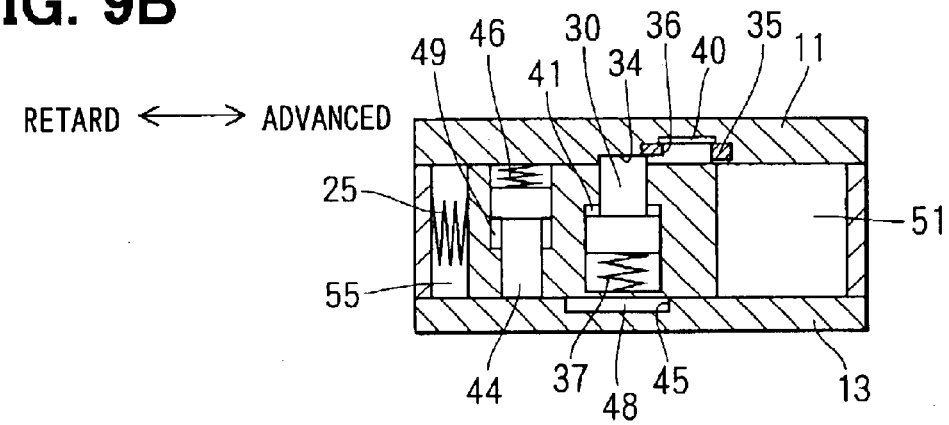
Figure 9C:
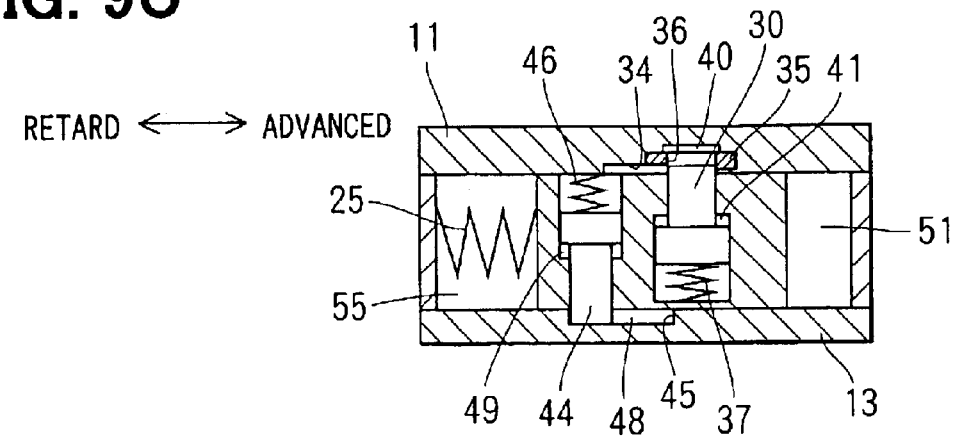
Figure 10:
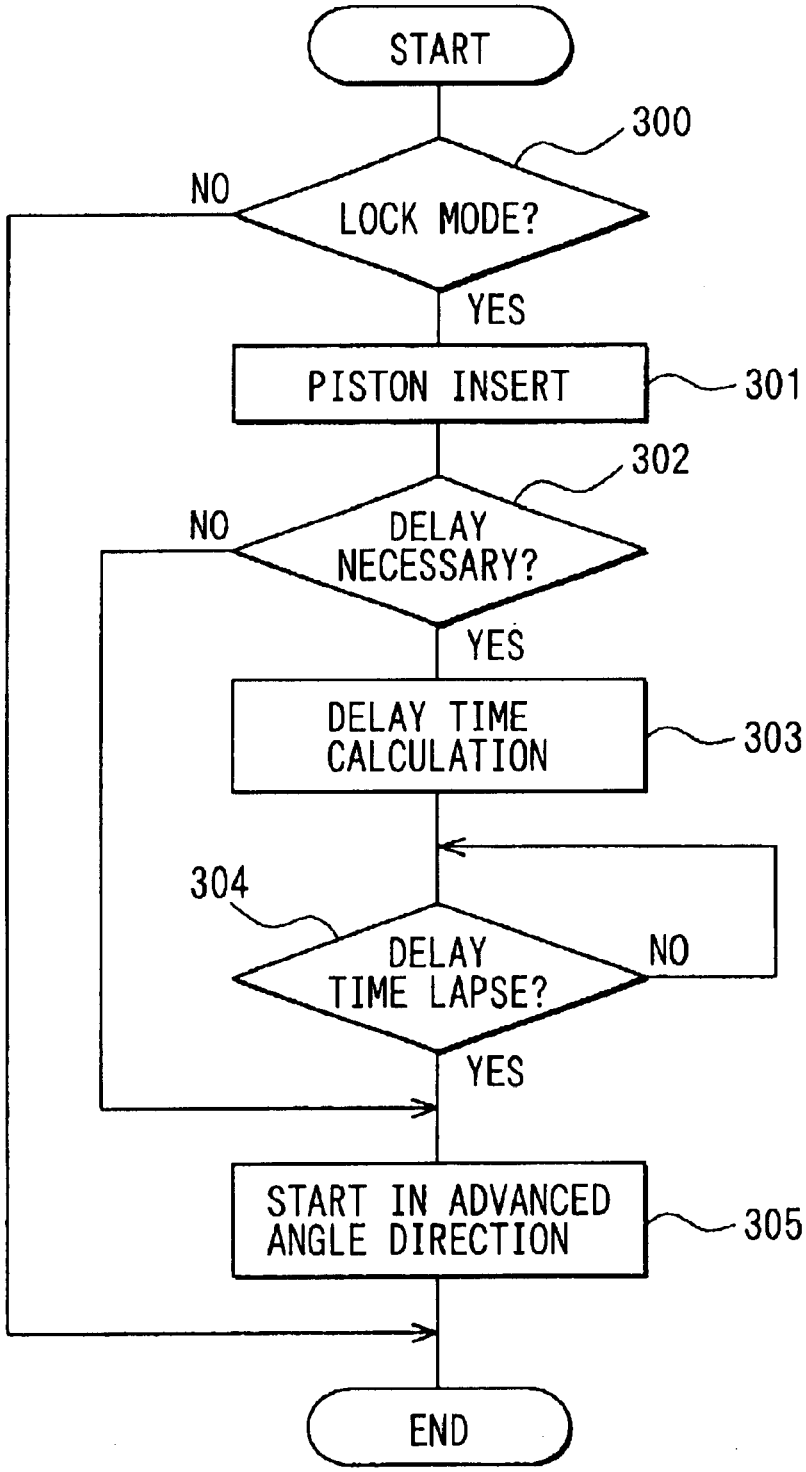
FIG. 10 is a flow chart showing a control routine when the lock piston is fitted in the fitting hole according to the first embodiment.
Figure 11A:
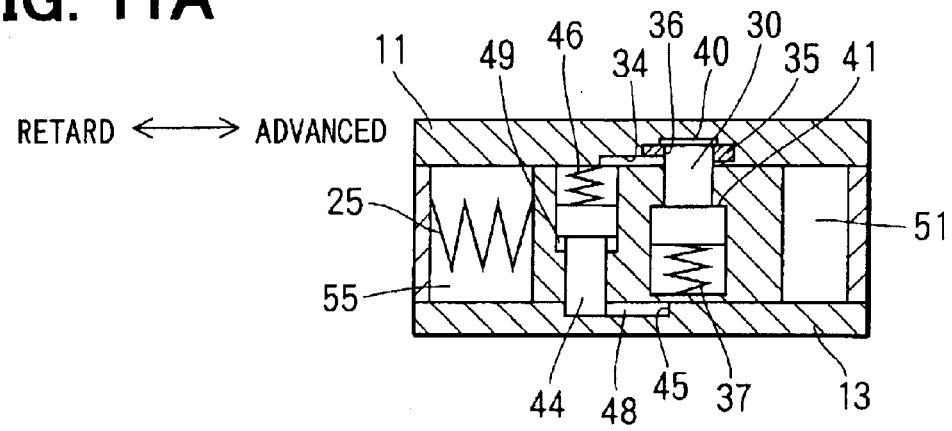
FIGS. 11A, 11B and 11C are schematic views showing an operation of the lock piston to be pulled out of the fitting hole according to the first embodiment.
Figure 11B:
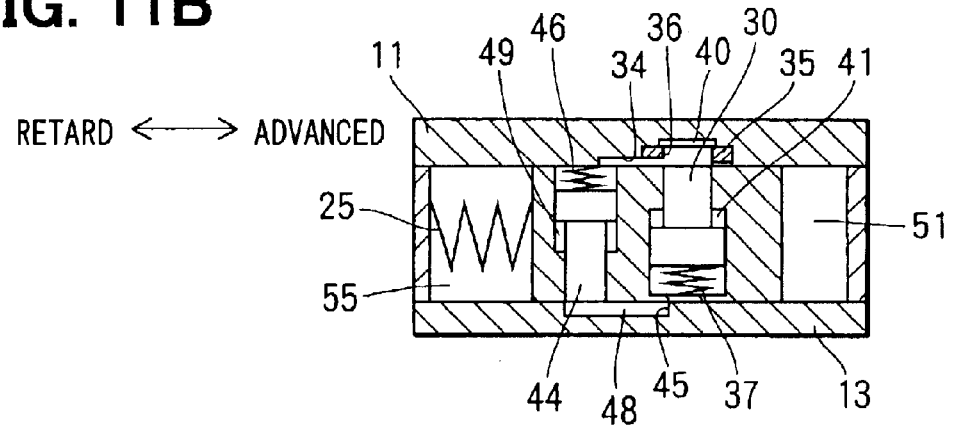
Figure 11C:
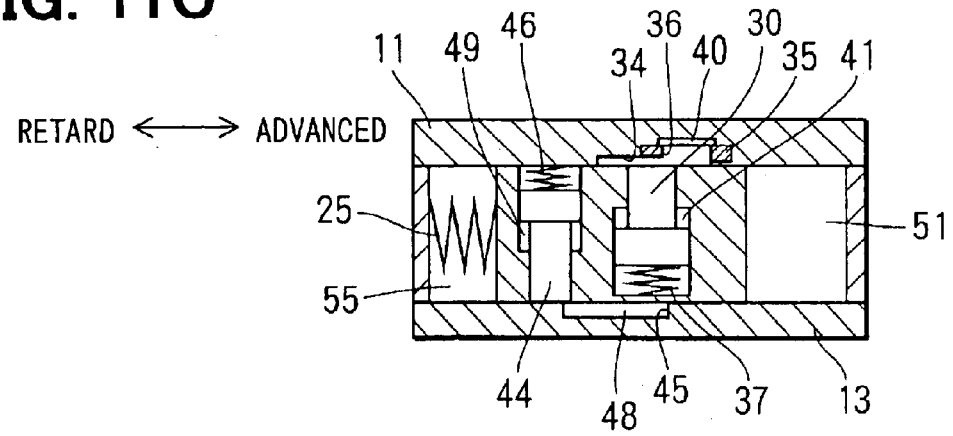

FIG. 10 shows a lock control routine for fitting the lock piston 30 in the fitting hole 36. At Step 300, it is determined whether or not there exists a lock mode at a time when the engine stops. Unless the lock mode exists, the routine ends. If the lock mode exists, the solenoid valve 240 is de-energized so that, as shown in FIGS. 9A and 9B, the lock piston 30 is urged toward the fitting hole 36 at Step 301. The restriction piston 44 is also urged toward the restriction hole 45 substantially at the same time when the lock piston is urged.

If it is determined that the lock piston 30 can be fitted in the fitting hole 36 without retarding the rotation start timing from the lock start timing, for example, in a case that the angular phase of the vane rotor 15 relative to the housing 10 is at a position in a vicinity of the most retard angle position, that is, if it is determined that delay control for the spool valve 230 is not necessary, the vane rotor 15 is driven relatively to the housing 10 in an advanced angle direction by duty ratio controlling the spool valve 230 at Step 305.

If it is determined that the delay control is necessary, the given delay time is defined from the delay time map based on input information representing the temperature and pressure of the operation oil at Step 303. And, if it is determined that the given delay time has lapsed at Step 304, the routine goes to Step 305 where the vane rotor 15 is driven relatively to the housing 10 in an advanced angle direction by duty ratio controlling the spool valve 230. Since the lock piston 30 protrudes toward the fitting hole 36, the lock piston 30 hits on the opening end of the fitting hole 36 on an advanced angle side so that the lock piston is confidently fitted in the fitting hole 36.

Even if the lock piston 30 passes the fitting hole 36, the restriction piston 44 hits on the end of the restriction hole 45 on a retard angle side since the vane rotor 15 is returned in retard angle direction by fluctuating torque that the camshaft 3 receives in a retard angle direction. Since the position where the restriction piston 44 hits on the end of the restriction hole on a retard angle side is the middle position, the lock piston 30 is confidently fitted in the the fitting hole 36.

Figure 12:
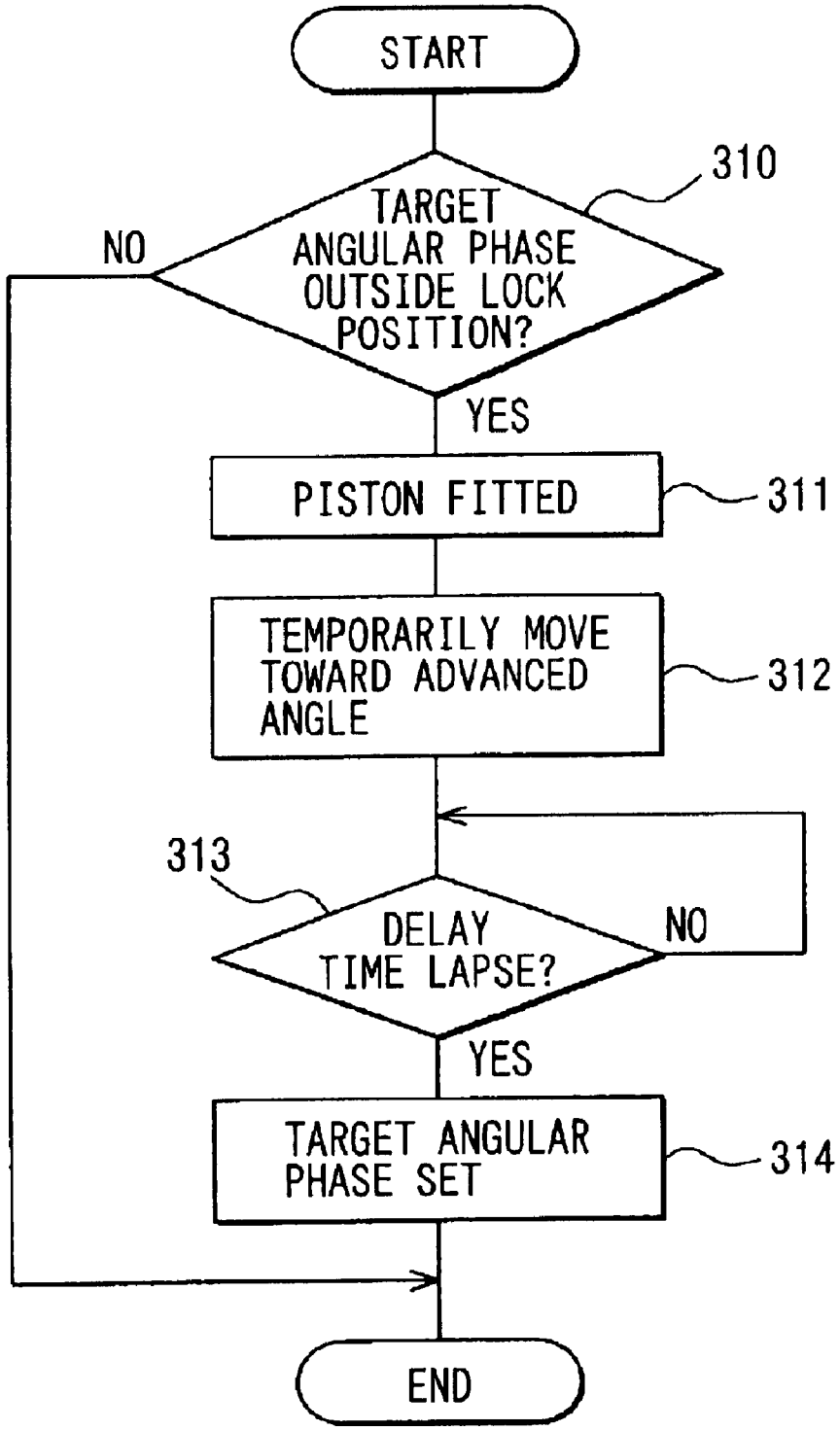
FIG. 12 is a flow chart showing a control routine when the lock piston is pulled out of the fitting hole according to the first embodiment.

When the engine is cranked, the lock piston 30 is pulled out of the fitting hole 36 according to a lock release control routine shown in FIG. 12. At first, it is determined at Step 310 whether or not a target angular phase of the vane rotor 15 relative to the housing 10 is outside a lock position that is the middle position, in another word, a position shifted from the lock position toward the most retard angle position or the most advanced angle position. If the target angular phase is at the lock position, not the position shifted from the lock position toward the most retard angle position or the most advanced angle position, this routine ends without pulling the lock piston 30 out of the fitting hole 36.

If the target angular phase is at the position shifted from the lock position toward the most retard angle position or the most advanced angle position, the solenoid valve 240 is energized at Step 311 so that the operation oil is supplied to the piston chambers 40, 41, 48 and 49. Next, the spool valve is duty ratio controlled so as to cause the vane rotor to receive hydraulic pressure in an advance angle direction at Step 312 and decrease the fluctuating torque that the vane rotor 15 receives in a retard angle direction so that the lock piston 30 is easily pulled out of the fitting hole 36.

Then, the given delay time is defined from the delay time map based on input information representing the temperature and pressure of the operation oil and, if it is determined that the given delay time has lapsed at Step 313, the target angular phase is set at Step 314 and the vane rotor 15 rotates relatively to the housing 10 to achieve the target angular phase.

According to the first embodiment, the start timing of rotating the vane rotor 15 relative to the housing 10 to the target angular phase is retard by the delay time defined by the temperature and pressure of the operation oil from the lock start timing of inserting the lock piston 30 into the fitting hole 36 or the lock release start timing of pulling the lock piston out of the fitting hole 36. Since the lock piston is confidently fitted in the fitting hole 36 at the time of the engine stop, the engine can be cranked with timing of the intake valve most suitable for engine cranking, which results in preventing engine cranking failure. Further, the lock piston 30 can be easily pulled out of the fitting hole 36.

In the first embodiment, the angular phase restriction means constituted by the restriction piston 44, the restriction hole 45, the spring 46 and piston chambers 48 and 49 may be omitted.

(Second Embodiment)

A valve timing adjusting apparatus according to a second embodiment is described with reference to FIGS. 13 to 16. According to the second embodiment, an oil supply route through which operation oil is supplied to the retard angle hydraulic chambers, the advanced angle hydraulic chamber and the piston chambers 40 and 41, which is controlled by the spool valve 230, is different from an oil supply route through which operation oil is supplied to the piston chambers 48 and 49, which is controlled by the solenoid valve 240.

At a normal engine operation, advanced angle hydraulic pressure is applied to the piston chamber 40 and retard angle hydraulic pressure is applied to the piston chamber 41 so that the rock piston 30 is pulled out of the fitting hole 36. The advanced angle hydraulic pressure may be applied to the piston chamber 41 and the retard angle hydraulic pressure may be applied to the piston chamber 40.

For example, in a case of rapidly reducing vehicle speed during a period when the vehicle is running at high and constant speed, it sometimes happens that, if the angular phase control near the most retard angle position is performed, the engine can not be normally operated because a valve overlap angle, that is, an angle by which a valve opening period of the intake valve overlaps with a valve opening period of the exhaust valve, does not meet the engine operating conditions. To prevent the abnormal condition of the engine mentioned above, it is preferable to perform the angular phase control within a range excluding a position near the most retard angle position in such a manner that the restriction piston 44 is urged to protrude into the restriction hole 45 by de-energizing the solenoid valve 240 and the restriction piston 44 is inserted into the restriction hole 45.

Figure 14:
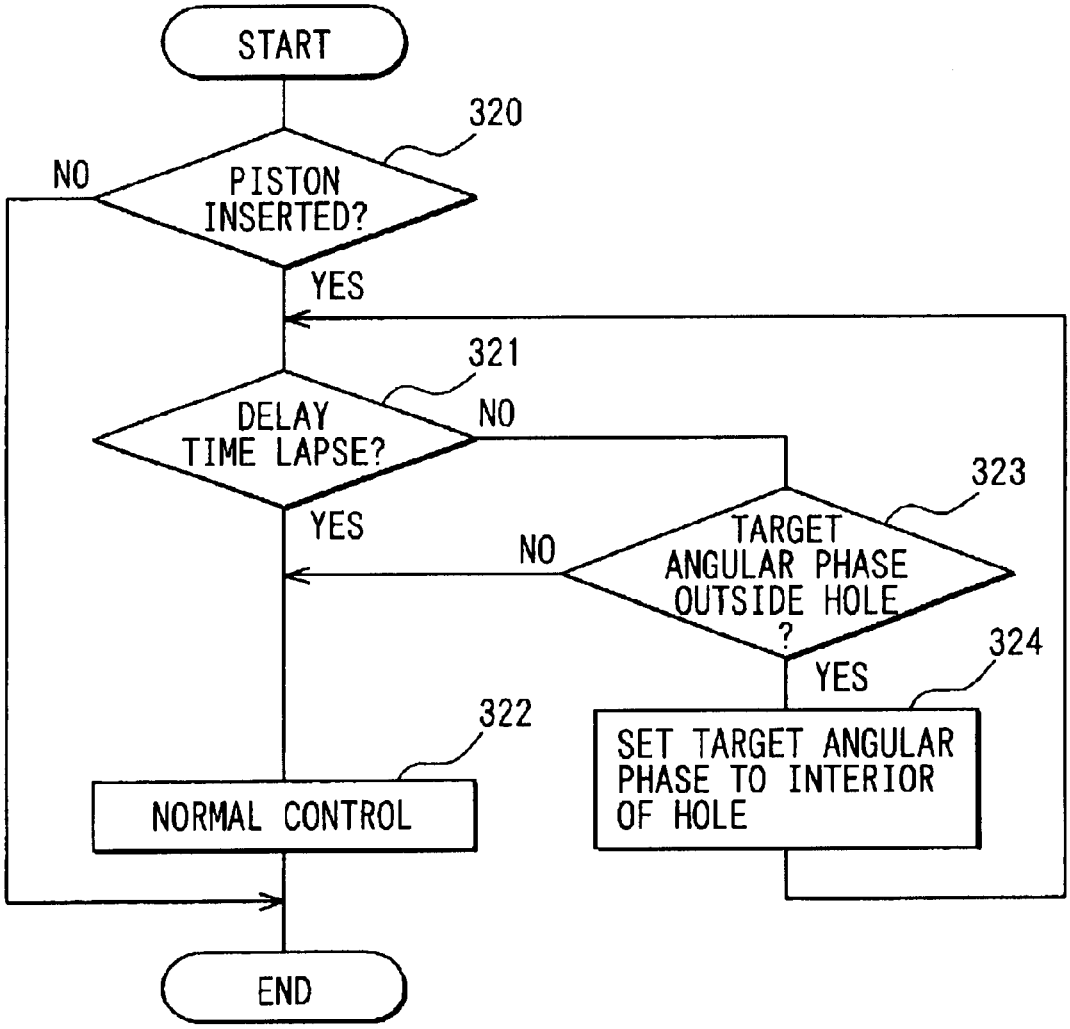
FIG. 14 is a flow chart showing a control routine when the restriction piston is inserted into the restriction hole according to the second embodiment.

The restriction piston 44 is inserted into the restriction hole 45 according to a control routine shown in FIG. 14. At Step 320, it is determined whether or not the restriction piston 44 should be inserted into the restriction hole 45. Unless it is determined that the restriction piston 44 should be inserted into the restriction hole 45, this routine ends. If it is determined that the restriction piston 44 should be inserted into the restriction hole 45, a given delay time is defined from the delay time map based on input information representing the temperature and pressure of the operation oil and it is determined whether or not the given delay time lapsed at Step 321. If it is determined that the given delay time has lapsed, the vane rotor 15 is controlled to rotate relatively to the housing 10 in a normal way to achieve the target angular phase at Step 322. Unless it is determined that the given delay time has lapsed, it is determined at Step 323 whether or not the restriction piston 44 is positioned angularly outside the restriction hole 45 in a state that the vane rotor 15 rotates relatively to the housing 10 to achieve the target angular phase. Unless the restriction piston 44 is positioned angularly outside the restriction hole 45, that is, if the restriction piston 44 is positioned angularly inside the restriction hole 45, the routine goes to Step 322 where the normal angular phase control is performed.

Figure 13A:
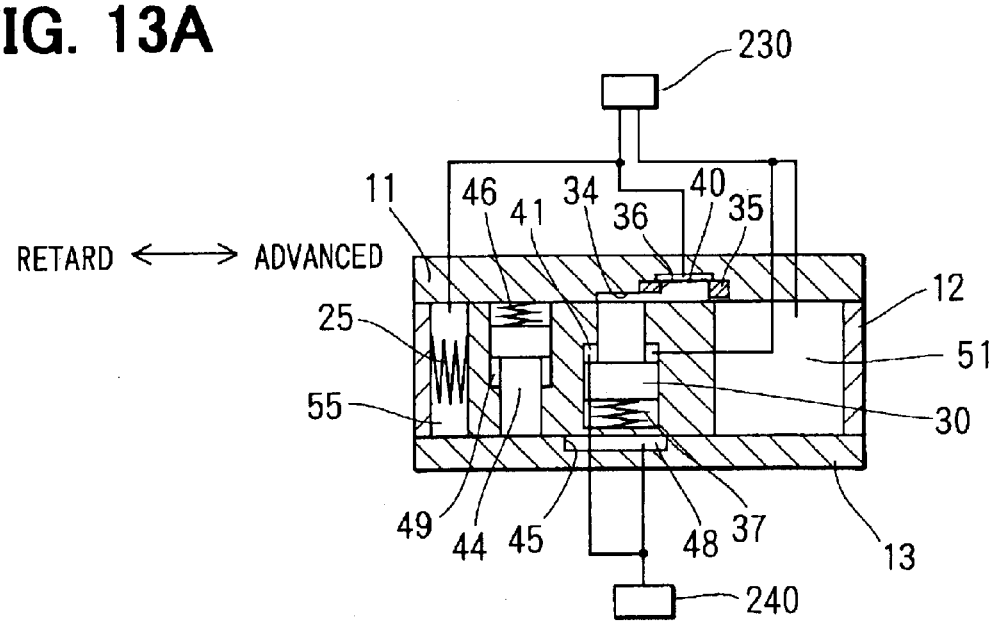
FIGS. 13A, 13B and 13C are schematic views showing oil passages and operation of a restriction piston to be inserted into a restriction hole according to a second embodiment of the present invention.
Figure 13B:
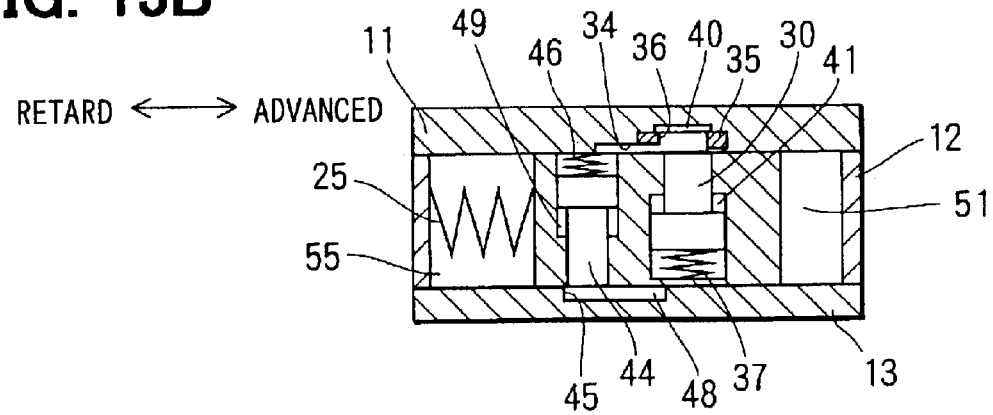
Figure 13C:
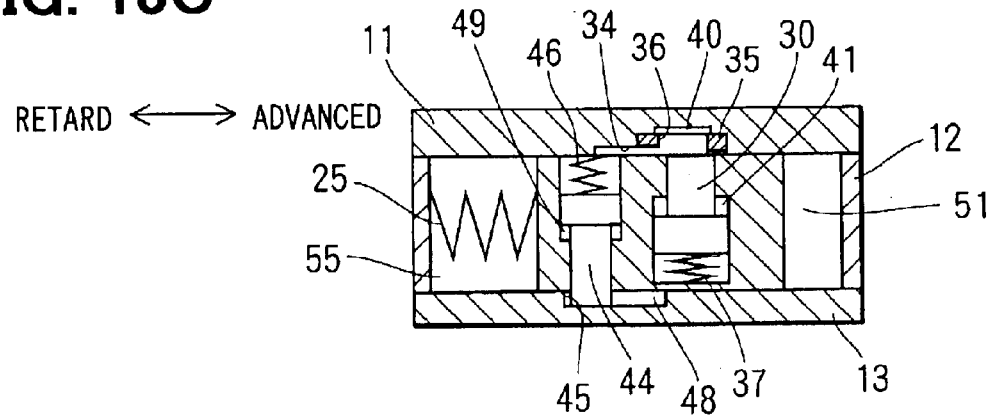

If the restriction piston 44 is positioned angularly outside the restriction hole 45, after the vane rotor 15 temporarily rotates relatively to the housing 10 to achieve a tentative target angular phase, as shown in FIGS. 13A and 13B, where the restriction piston 44 is positioned angularly inside the restriction hole and in a vicinity of an end of the restriction hole 45 on a retard angle side or on an advanced angle side at Step 324, the routine goes to Step 321. Since the vane rotor 15 moves to achieve the tentative target angular phase within the given delay time, the restriction piston 44 can be inserted into the restriction hole 45 without fail within the given delay time, as shown in FIG. 13C. After the given delay time lapses, the normal angular phase control is performed. At this time, the angular phase is limited within a range defined by the end of the restriction hole 45 on a retard angle side and the other end of the restriction hole 45 on an advanced angle side.

Since, when the target angular phase calculated before the given delay time lapses is at the position where the restriction piston 44 is positioned angularly outside the restriction hole 45, the vane rotor 15 temporarily rotates relatively to the housing 10 to achieve the tentative target angular phase within the given delay time, time necessary for rotating the vane rotor to the target angular phase after the given delay time lapses is shorter.

Figure 15A:
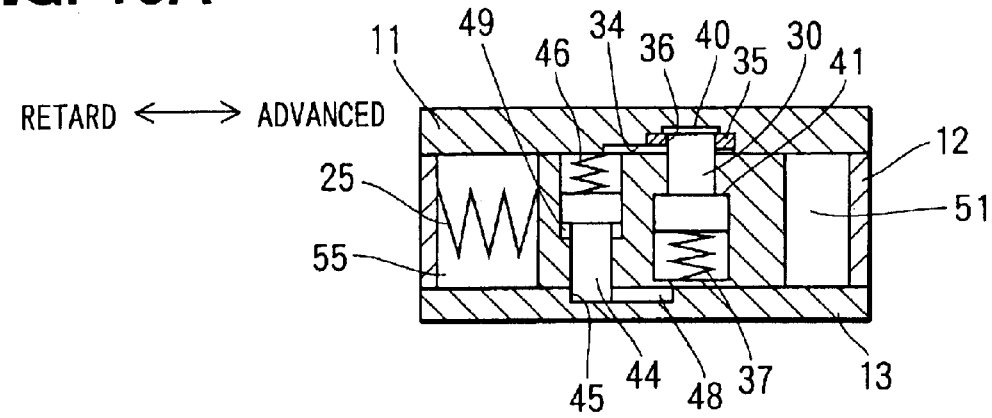
FIGS. 15A, 15B and 15C are schematic views showing an operation of the restriction piston to be pulled out of the restriction hole according to a second embodiment.
Figure 15B:
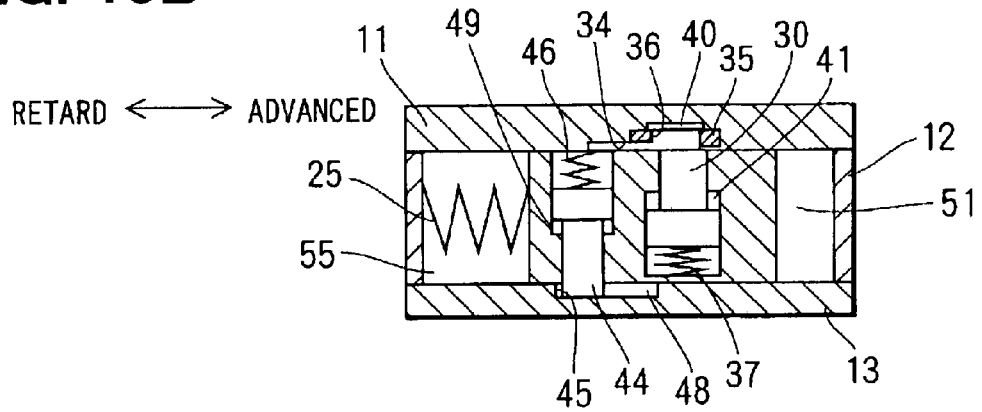
Figure 16:
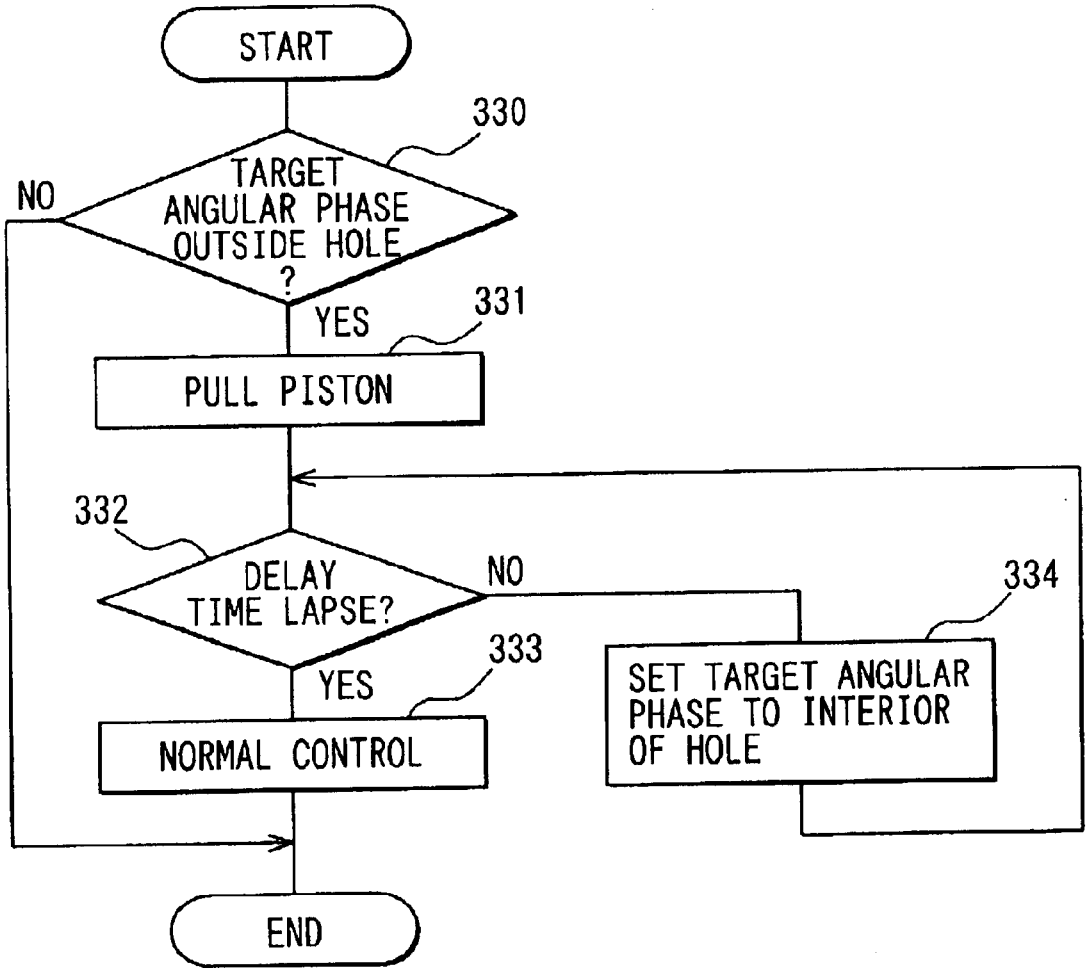
FIG. 16 is a flow chart showing a control routine when the restriction piston is pulled out of the restriction hole according to the second embodiment.

FIG. 16 shows a control routine for pulling the restriction piston 44 out of the restriction hole 45 as shown in FIG. 15A.

Figure 15C:
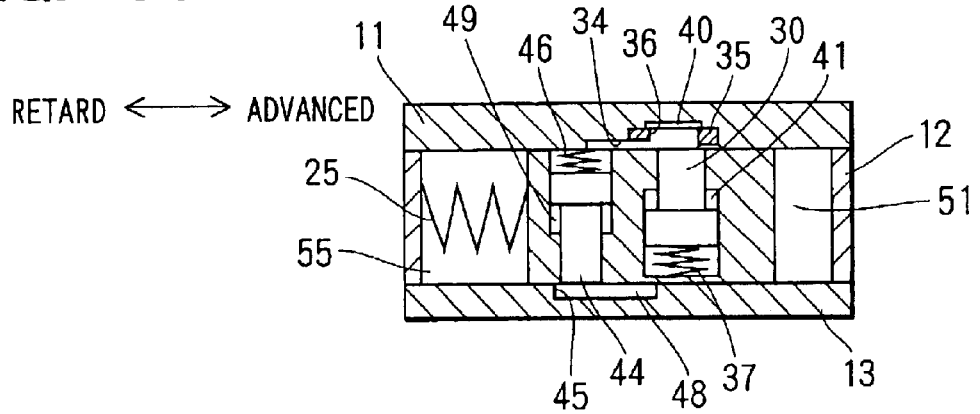

At Step 330, it is determined whether or not the target angular phase is at a position where the restriction piston 44 is outside the restriction hole 45. If the target angular phase is at a position where the restriction piston 44 is not outside the restriction hole 45 but inside the restriction hole 45, this routine ends. If the target angular phase is at the position where the restriction piston 44 is outside the restriction hole 45, the solenoid valve is de-energized at Step 331 for pulling the restriction piston 44 out of the restriction hole 45. A given delay time is defined from the delay time map based on input information representing the temperature and pressure of the operation oil and it is determined whether or not the given delay time lapsed at Step 332. If it is determined that the given delay time has lapsed, the vane rotor 15 is controlled to rotate relatively to the housing 10 in a normal way to achieve the target angular phase at Step 333. Unless it is determined that the given delay time has lapsed, the vane rotor 15 rotate to achieve a tentative target angular phase where the restriction piston 44 is positioned angularly inside the restriction hole 45 and in a vicinity of an end of the restriction hole on a retard angle side or on an advanced angle side at Step 334. At this time, as shown in FIG. 15C, the restriction piston 44 can be easily pulled out of the restriction hole 45 since the restriction piston 44 is inside the restriction hole 45 and in a vicinity of the end of the restriction hole on a retard angle side or on an advanced angle side so that the restriction piston 44 is not in contact with inner wall of the restriction hole 45.

In the second embodiment, the angular phase locking means constituted by the lock piston 30, the fitting hole 36, the spring 37 and piston chambers 40 and 41 may be omitted.

In the first and second embodiments, instead of the delay time map from which the given delay time is defined based on the sensor signals representing the temperature of pressure of the operation oil, numerical formula corresponding to the map may be used. The given delay time may be fixed value.

Further, the valve timing adjusting apparatus mentioned above may be applied to the exhaust valve instead of the intake valve or may be applied commonly to both of the intake valve and the exhaust valve.

Furthermore, instead of a structure that a direction in which the lock piston 30 is inserted toward the fitting hole 36 is an axial direction of the vane rotor 15, the valve timing adjusting apparatus may have a structure that a direction in which the lock piston is inserted toward the fitting hole perpendicularly to the axial direction of the vane rotor. Moreover, the lock piston may be mounted on the housing and the fitting hole may be provided in the vane rotor.

Still further, instead of the chain sprocket through which the rotating drive force of the camshaft is transmitted to the camshaft, a timing pulley or a timing gear may be used for the same purpose. As an alternative, the vane rotor may receive the drive force of the crankshaft and the housing may be rotated together with the camshaft.

Further, instead of the vane type valve timing adjusting apparatus mentioned above, in a valve timing adjusting apparatus in which a drive force transmitting member having a helical spline engagement mechanism is disposed between the drive side rotating member rotatable with the crankshaft and the driven side rotating member rotatable with the camshaft and the angular phase of the driven side rotating member relative to the drive side rotating member is varied by hydraulically moving reciprocatingly the drive force transmitting member, the lock or restriction piston and the angular phase locking or restriction means may be provided.

Further, instead of the timing gear through which drive force of the crankshaft is transmitted to the camshaft, a timing pulley or a chain sprocket may be used.

What is claimed is:

1. A valve timing adjusting apparatus disposed between a drive shaft of an internal combustion engine and a driven shaft causing an opening and closing operation of at least one of an intake valve and an exhaust valve and operative to change an angular phase of the driven shaft relative to the drive shaft so that opening and closing timing of the at least one of an intake valve and an exhaust valve may be varied, comprising:

a drive side rotating member rotatable together with the drive shaft;

a driven side rotating member rotatable together with the driven shaft, a rotation control pressure chamber operative to rotate the driven side rotating member relative to the drive side rotating member so that angular phase of the driven side rotating member relative to the drive side rotating member is controlled to a target position between the most retard angle position and the most advanced angle position in response to hydraulic pressure applied thereto;

a lock piston provided in one of the driven and drive side rotating members;

a fitting hole provided in the other of the driven and drive side rotating members; and an angular phase locking pressure chamber operative to execute one of first and second operations when hydraulic pressure is applied thereto and the other of the first and second operations when application of the hydraulic pressure thereto is released, the first operation being to insert the lock piston into the fitting hole so as to lock the angular phase of the driven side rotating member relative to the drive side rotating member to a middle position between the most retard angle position and the most advanced angle position, and the second operation being to pull the lock piston out of the fitting hole so as to release lock of the angular phase of the driven side rotating member relative to the drive side rotating member at the middle position, wherein a supply route of the hydraulic pressure to the rotation control pressure chamber is different from that to the angular phase locking pressure chamber and, when at least one of the first and second operations is executed, start timing of rotation of the driven side rotating member relative to the drive side rotating member so as to change the angular phase of the driven side rotating member relative to the drive side rotating member to the target position is retard by a given delay time from start timing of execution of the at least one of the first and second operations.

2. A valve timing adjusting apparatus according to claim 1, wherein the lock piston is provided at an axial end thereof with a tapered portion whose diameter is smaller toward the round hole, the fitting hole is provided at an opening end thereof with a chamfering portion whose diameter is larger toward the piston, and, when the first operation is executed, the given delay time by which the start timing of rotation of the driven side rotating member relative to the drive side rotating member is retard from the start timing of execution of the first operation is larger than time required for the tapered portion to pass the chamfering portion after the first operation starts.

3. A valve timing adjusting apparatus according to claim 1, wherein the start timing of rotation of the driven side rotating member relative to the drive side rotating member is retard by a first given delay time from the start timing of execution of the first operation and by a second given delay time from start timing of execution of the second operation.

4. A valve timing adjusting apparatus according to claim 1, wherein, when the second operation is executed, the start timing of rotation of the driven side rotating member relative to the drive side rotating member is retard by the given delay time from the start timing of execution of the second operation.

5. A valve timing adjusting apparatus according to claim 4, wherein, after the second operation starts, the hydraulic pressure is applied to the rotation control pressure chamber in such a manner that the angular phase of the driven side rotating member relative to the drive side rotating member is kept at the middle position between the most retard angle position and the most advanced angle position or temporarily moved to a position slightly shifted from the middle position toward the advanced angle position before the given delay time lapses.

6. A valve timing adjusting apparatus according to claim 1, wherein the given delay time by which the start timing of rotation of the driven side rotating member relative to the drive side rotating member is retard from the start timing of execution of the at least one of the first and second operations is determined by sensor signals representing pressure and temperature of fluid applied to at least one of the rotation control pressure chamber and the angular phase locking pressure chamber.

7. A valve timing adjusting apparatus according to claim 1, further comprising:

a restriction piston provided in one of the driven and drive side rotating members;

a restriction hole formed in shape of an arc extending within a given angular range and provided in the other of the driven and drive side rotating members; and an angular phase restriction pressure chamber operative to execute one of third and fourth operations when hydraulic pressure is applied thereto and the other of the third and fourth operations when application of the hydraulic pressure thereto is released, the third operation being to insert the restriction piston into the restriction hole so as to restrict rotation of the driven side rotating member relative to the drive side rotating member within the given angular range and the fourth operation being to pull the restriction piston out of the restriction hole so as to release restriction of rotation of the driven side rotating member relative to the drive side rotating member within the given angular range, wherein a supply route of the hydraulic pressure to the angular phase restriction pressure chamber is same as that to the angular phase locking pressure chamber, an end of the given angular range is at a position corresponding to the middle position between the most retard angle position and the most advanced angle position and the other end of the given angular range is at a position away from the middle position toward the most advanced angle position and, when the third operation is executed together with the first operation, the restriction piston abuts on the end of the given angular range within the restriction hole.

8. A valve timing adjusting apparatus according to claim 1, further comprising:

a mechanical pump rotatable together with the engine for supplying the hydraulic pressure via the supply routes to the rotation control pressure chamber and the angular phase locking pressure chamber.

9. A valve timing adjusting apparatus according to claim 1, wherein one of the driven and drive side rotating members is a housing having an accommodation chamber and the other of the driven and drive side rotating members is a vane rotatable within a defined angular range in the housing and having a partition with which the accommodation chamber is separated into two rooms one of which is a retard angle pressure chamber and the other of which is an advanced angle pressure chamber, whereby the vane is rotated relatively to the housing by controlling the hydraulic pressures applied to the respective retard and advanced angle pressure chambers.

10. A valve timing adjusting apparatus disposed between a drive shaft of an internal combustion engine and a driven shaft causing an opening and closing operation of at least one of an intake valve and an exhaust valve and operative to change an angular phase of the driven shaft relative to the drive shaft so that opening and closing timing of the at least one of an intake valve and an exhaust valve may be varied, comprising:

a drive side rotating member rotatable together with the drive shaft;

a driven side rotating member rotatable together with the driven shaft, a rotation control pressure chamber operative to rotate the driven side rotating member relative to the drive side rotating member so that angular phase of the driven side rotating member relative to the drive side rotating member is controlled to a target position between the most retard angle position and the most advanced angle position in response to hydraulic pressure applied thereto;

a restriction piston provided in one of the driven and drive side rotating members;

a restriction hole formed in shape of an arc extending within a given angular range and provided in the other of the driven and drive side rotating members, an end of the restriction hole constituting a retard angle side end and the other end thereof constituting an advance angle side end; and an angular phase restriction pressure chamber operative to execute one of first and second operations when hydraulic pressure is applied thereto and the other of the first and second operations when application of the hydraulic pressure thereto is released, the first operation being to insert the restriction piston into the restriction hole so as to restrict rotation of the driven side rotating member relative to the drive side rotating member within the given angular range and the second operation being to pull the restriction piston out of the restriction hole so as to release restriction of rotation of the driven side rotating member relative to the drive side rotating member within the given angular range, wherein a supply route of the hydraulic pressure to the rotation control pressure chamber is different from that to the angular phase restriction pressure chamber and, when at least one of the first and second operations is executed, start timing of rotation of the driven side rotating member relative to the drive side rotating member so as to change the angular phase of the driven side rotating member relative to the drive side rotating member to the target position is retard by a given delay time from start timing of execution of the at least one of the first and second operations.

11. A valve timing adjusting apparatus according to claim 10, wherein, when the first operation is executed, the hydraulic pressure is applied to the rotation control pressure chamber in such a manner that, if the restriction piston is outside the given angular range of the restriction hole, the angular phase of the driven side rotating member relative to the drive side rotating member is temporarily moved to a position slightly inside the given angular range of the restriction hole before the given delay time lapses, whereby, when the driven side rotating member is rotated relatively to the drive side rotating member after the given delay time lapses, the target position of the angular phase of the driven side rotating member relative to the drive side rotating member is restricted within the given angular range since the restriction piston abuts on the retard angle side end or the advanced angle side end.

12. A valve timing adjusting apparatus according to claim 10, wherein the start timing of rotation of the driven side rotating member relative to the drive side rotating member is retard by a first given delay time from the start timing of execution of the first operation and by a second given delay time from start timing of execution of the second operation.

13. A valve timing adjusting apparatus according to claim 10, wherein, when the second operation is executed, the start timing of rotation of the driven side rotating member relative to the drive side rotating member is retard by the given delay time from the start timing of execution of the second operation.

14. A valve timing adjusting apparatus according to claim 13, wherein, after the second operation starts, the hydraulic pressure is applied to the rotation control pressure chamber in such a manner that, before the given delay time lapses, the angular phase of the driven side rotating member relative to the drive side rotating member is temporarily moved to a position slightly away inward from the retard angle side end or the advanced angle side end of the restriction hole on which the restriction piston abuts so as to pull smoothly the restriction piston out of the restriction hole.

15. A valve timing adjusting apparatus according to claim 10, wherein the given delay time by which the start timing of rotation of the driven side rotating member relative to the drive side rotating member is retard from the start timing of execution of the at least one of the first and second operations is determined by sensor signals representing pressure and temperature of fluid applied to at least one of the rotation control pressure chamber and the angular phase restriction pressure chamber.

16. A valve timing adjusting apparatus according to claim 10, further comprising:

a lock piston provided in one of the driven and drive side rotating members;

a fitting hole provided in the other of the driven and drive side rotating members; and an angular phase locking pressure chamber operative to execute one of third and fourth operations when hydraulic pressure is applied thereto and the other of the third and fourth operations when application of the hydraulic pressure thereto is released, the third operation being to insert the lock piston into the fitting hole so as to lock the angular phase of the driven side rotating member relative to the drive side rotating member to a given position within the given angular range of the restriction hole and the fourth operation being to pull the lock piston out of the fitting hole so as to release lock of the angular phase of the driven side rotating member relative to the drive side rotating member at the given position, wherein a supply route of the hydraulic pressure to the angular phase locking pressure chamber is same as that to the rotation control pressure chamber.

17. A valve timing adjusting apparatus according to claim 10, further comprising:

a mechanical pump rotatable together with the engine for supplying the hydraulic pressure via the supply routes to the rotation control pressure chamber and the angular phase restriction pressure chamber.

18. A valve timing adjusting apparatus according to claim 10, wherein one of the driven and drive side rotating members is a housing having an accommodation chamber and the other of the driven and drive side rotating members is a vane rotatable within a defined angular range in the housing and having a partition with which the accommodation chamber is separated into two rooms one of which is a retard angle pressure chamber and the other of which is an advanced angle pressure chamber, whereby the vane is rotated relatively to the housing by controlling the hydraulic pressures applied to the respective retard and advanced angle pressure chambers.

* * * * *